US010206485B2

(12) United States Patent
Chung

(10) Patent No.: US 10,206,485 B2
(45) Date of Patent: Feb. 19, 2019

(54) INTEGRATED TEARDROP APPLICATOR, COMPRESSION-FIT VESSEL, AND APPLIQUE MANIPULATORS

(71) Applicant: Pui Yan Chung, San Diego, CA (US)

(72) Inventor: Pui Yan Chung, San Diego, CA (US)

( * ) Notice: Subject to any disclaimer, the term of this patent is extended or adjusted under 35 U.S.C. 154(b) by 0 days.

(21) Appl. No.: 15/383,038

(22) Filed: Dec. 19, 2016

(65) Prior Publication Data

US 2017/0099931 A1 Apr. 13, 2017

Related U.S. Application Data

(62) Division of application No. 13/751,036, filed on Jan. 25, 2013, now Pat. No. 9,538,829.

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01)

(58) Field of Classification Search
CPC combination set(s) only.
See application file for complete search history.

(56) References Cited

U.S. PATENT DOCUMENTS 4,403,624 A * 9/1983 Montgomery ..... A45D 40/267 132/218
5,226,744 A * 7/1993 Kemmerer ..... A45D 34/046 132/218
5,349,972 A * 9/1994 Dirksing ..... A45D 40/267 132/218
5,397,193 A * 3/1995 Kirk, III ..... A45D 40/267 401/122
5,722,436 A * 3/1998 Vandromme ..... A45D 40/267 132/218
6,033,143 A * 3/2000 Gueret ..... A45D 34/045 401/126
6,264,390 B1 * 7/2001 Lee ..... A45D 40/268 401/121
7,918,619 B2 * 4/2011 Gueret ..... A45D 40/262 401/122
8,021,066 B2 * 9/2011 Thiebaut ..... A45D 34/045 401/121
8,403,580 B2 * 3/2013 De Laforcade ..... A45D 40/267 401/122

* cited by examiner

*Primary Examiner* — David Walczak
(74) *Attorney, Agent, or Firm* — Genius Patent APC; Bruce Hare

(57) ABSTRACT

An applique vessel for storing applique includes: an interior surface; and an applique removal feature positioned along a portion of the interior surface. An applique vessel for storing applique includes: a body adapted to store applique; and a top comprising an application element, where the body and the top adapted to form a vessel if coupled, and the top is adapted to couple to the body via a compression fit. An applique system adapted to store and apply applique includes: a flexible body adapted to store applique; a top including an application element; and an applique removal feature positioned along a portion of the flexible body. An application element adapted to apply applique to a user includes: a frame having a particular shape; and a set of protuberances extending from the frame.

4 Claims, 6 Drawing Sheets

INTEGRATED TEARDROP APPLICATOR, COMPRESSION-FIT VESSEL, AND APPLIQUE MANIPULATORS

CROSS-REFERENCE TO RELATED APPLICATIONS

This application is a divisional of U.S. patent application Ser. No. 13/751,036, filed on Jan. 25, 2013, now U.S. Pat. No. 9,538,829.

BACKGROUND

Makeup applicators are used for applying applique. Such applique may have various consistencies, viscosity, and/or other attributes. Users may want to apply the applique with an applicator that is loaded with a desired amount and consistency of applique. Current solutions may provide an applicator that does not allow for removal of excess applique.

Many types of makeup, for instance mascara, may require a particular consistency of applique on an applicator. Many current applicators may provide a consistency of applique that is thicker than desired, resulting in "clumping" that causes unsightly results after applying the applique material.

Thus there is a need for an applicator and associated vessel that is able to conveniently and automatically remove excess applique without requiring any additional user effort or external tools.

BRIEF SUMMARY

Some embodiments provide an applique vessel that includes various excess applique removal elements (or manipulators). Such elements may be arranged in various different configurations, as appropriate. Different embodiments provide differently shaped application elements. Such elements may be shaped in various different ways, as appropriate. Some embodiments may provide a flexible (or squeezable) vessel such that a user may actively manipulate the amount of applique retained by an application element. Some embodiments may include a vessel with a compression fit top including an application element.

In one exemplary embodiment, an applique vessel for storing applique is provided. The vessel includes: an interior surface; and an applique removal feature positioned along a portion of the interior surface.

In another exemplary embodiment, an applique vessel for storing applique is provided. The vessel includes: a body adapted to store applique; and a top comprising an application element, where the body and the top adapted to form a vessel if coupled, and the top is adapted to couple to the body via a compression fit.

In yet another exemplary embodiment, an applique system adapted to store and apply applique is provided. The system includes: a flexible body adapted to store applique; a top including an application element; and an applique removal feature positioned along a portion of the flexible body.

In still another exemplary embodiment, an application element adapted to apply applique to a user is provided. The application element includes: a frame having a particular shape;

and a set of protuberances extending from the frame.

The preceding Summary is intended to serve as a brief introduction to some embodiments of the invention. It is not meant to be an introduction or overview of all inventive subject matter disclosed in this document. The Detailed Description that follows and the Drawings (or "Figures" or "FIGs.") that are referred to in the Detailed Description will further describe the embodiments described in the Summary as well as other embodiments. Accordingly, to understand all the embodiments described by this document, a full review of the Summary, Detailed Description and the Drawings is needed. Moreover, the claimed subject matter is not to be limited by the illustrative details in the Summary, Detailed Description and the Drawings, but rather is to be defined by the appended claims, because the claimed subject matter may be embodied in other specific forms without departing from the spirit of the invention.

BRIEF DESCRIPTION OF THE DRAWINGS

The novel features of the invention are set forth in the appended claims. However, for purpose of explanation, several embodiments of the invention are set forth in the following drawings.

DETAILED DESCRIPTION

In the following detailed description of the invention, numerous details, examples, and embodiments of the invention are set forth and described. However, it will be clear and apparent to one skilled in the art that the invention is not limited to the embodiments set forth and that the invention may be practiced without some of the specific details and examples discussed.

Figure 1:
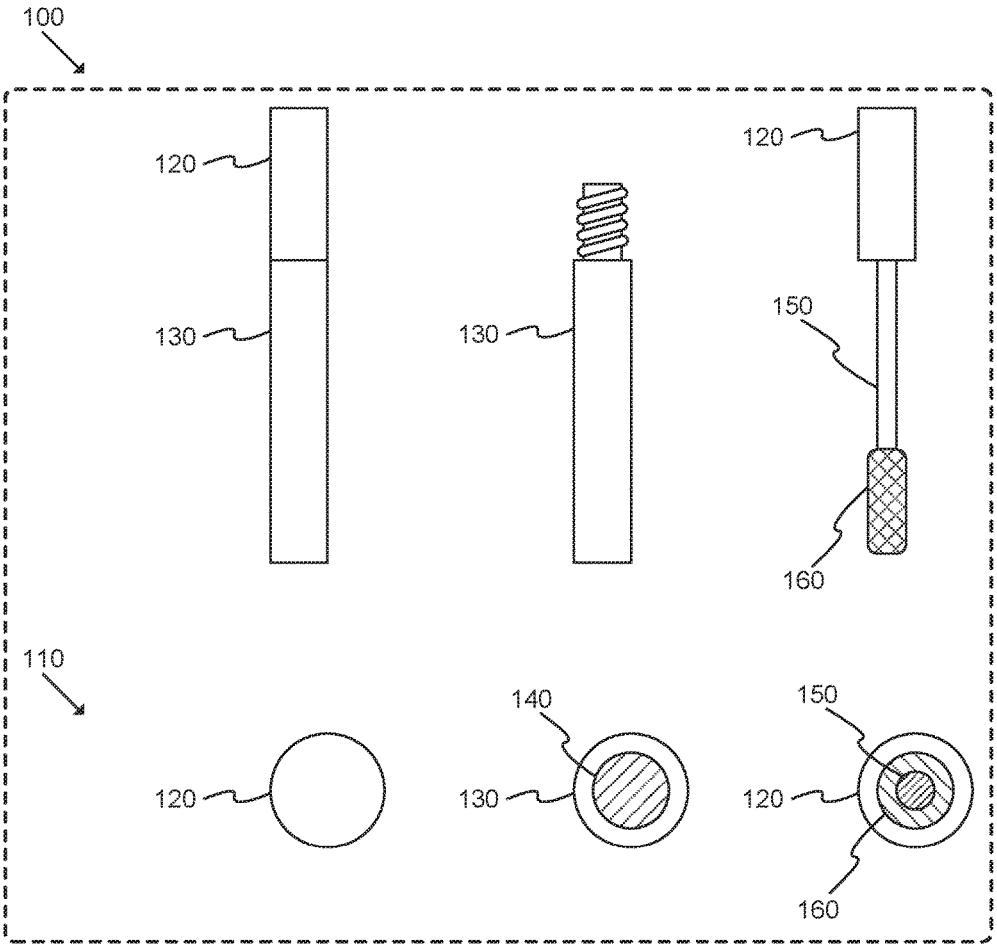
FIG. 1 illustrates side and top views of an applicator and associated vessel.

FIG. 1 illustrates side and top views of an applicator 120 and associated vessel 130. Specifically, this figure shows an example arrangement that may be used by some embodiments to facilitate removal of excess applique. As shown, the applicator 120 may include a wand 150 extending from a handle coupled to an application element 160. The wand 150 may have a first diameter and the applicator 160 may have a second diameter. The first diameter may be less than the second diameter, as appropriate. The vessel 130 may include a reservoir portion 140 (e.g., a volume that allows storage of mascara).

During operation, such an applicator 120 and vessel 130 may allow a user to insert a portion of the applicator element 160 and wand 150 into the reservoir portion 140 of the vessel 130. The user may then withdraw the applicator element 160 and wand 150 such that the applicator element 160 has retained some amount of material stored in the reservoir 140. The retained material may then be applied to a user as appropriate (e.g., by brushing mascara onto eyelashes of the user).

One of ordinary skill in the art will recognize that the system of FIG. 1 may be implemented in various different ways without departing from the spirit of the invention. For instance, different embodiments may include different vessels of differing size, shape, dimension (e.g., height, width, depth, radius, etc.), etc. As another example, various elements of the system 100 may be provided in various different combinations (e.g., some embodiments may include a modified applicator element 160, other embodiments may provide a differently shaped vessel 130, etc.).

Figure 2:
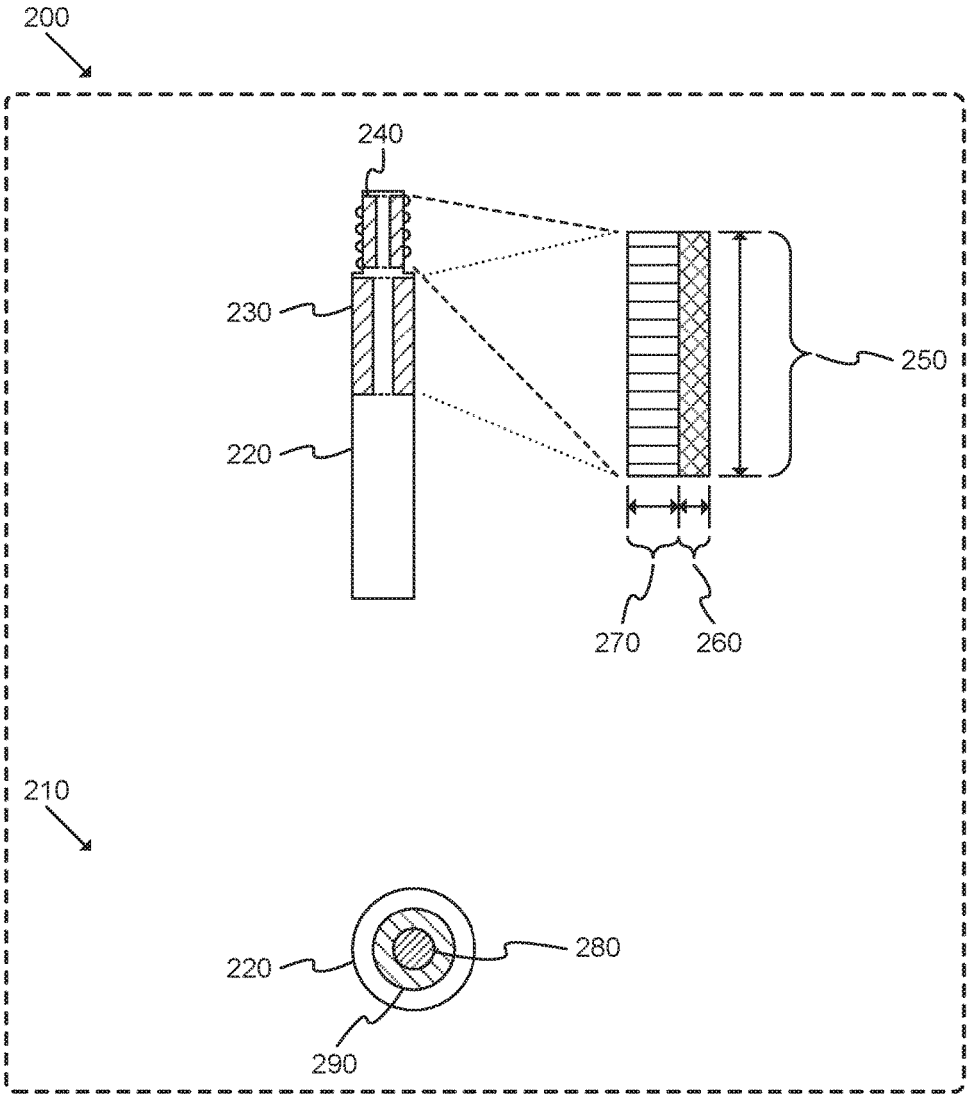
FIG. 2 illustrates a sectional side and top view of a vessel according to an exemplary embodiment of the invention.

FIG. 2 illustrates a sectional side 200 and top view 210 of a vessel 220 according to an exemplary embodiment of the invention. Specifically, this figure shows the potential positioning of various applique manipulators 230-240 provided by some embodiments. As shown, the vessel 220 of some embodiments may include a first manipulator 230 (e.g., positioned along the body of the vessel 220) and/or a second manipulator 240 (e.g., positioned along the neck of the vessel 220). Each of the manipulators may have an associated length 250 and width (or depth). The width or depth of each manipulator may include a structural section 260 and a manipulation section 270.

The structural section 260 may include various structural backings and/or adhesives that may allow the structural section to be attached to the vessel 220 in a secure fashion. The manipulation section 270 may include various elements and/or features that may be adapted to remove excess applique from the applicator of some embodiments.

In addition, as shown in the top view 210, the vessel 220 may include a reservoir area 280 for storing applique material and a manipulator area 290 that extends radially from the sides of the vessel 220 in some embodiments.

One of ordinary skill in the art will recognize that although the applicator vessel 220 has been described with reference to various details, different embodiments may implement the vessel in various different ways without departing from the spirit of the invention. For instance, different embodiments may include different elements of different dimension within the structural section 260 of some embodiments (e.g., adhesive layers of differing widths, support layers such as lattice structures (not shown), etc.). Such elements may be made of various appropriate materials (e.g., metal, plastic, bristle, etc.). In addition, some embodiment may divide a manipulator into multiple sections, where each section may include a different manipulator configuration.

Figure 3:
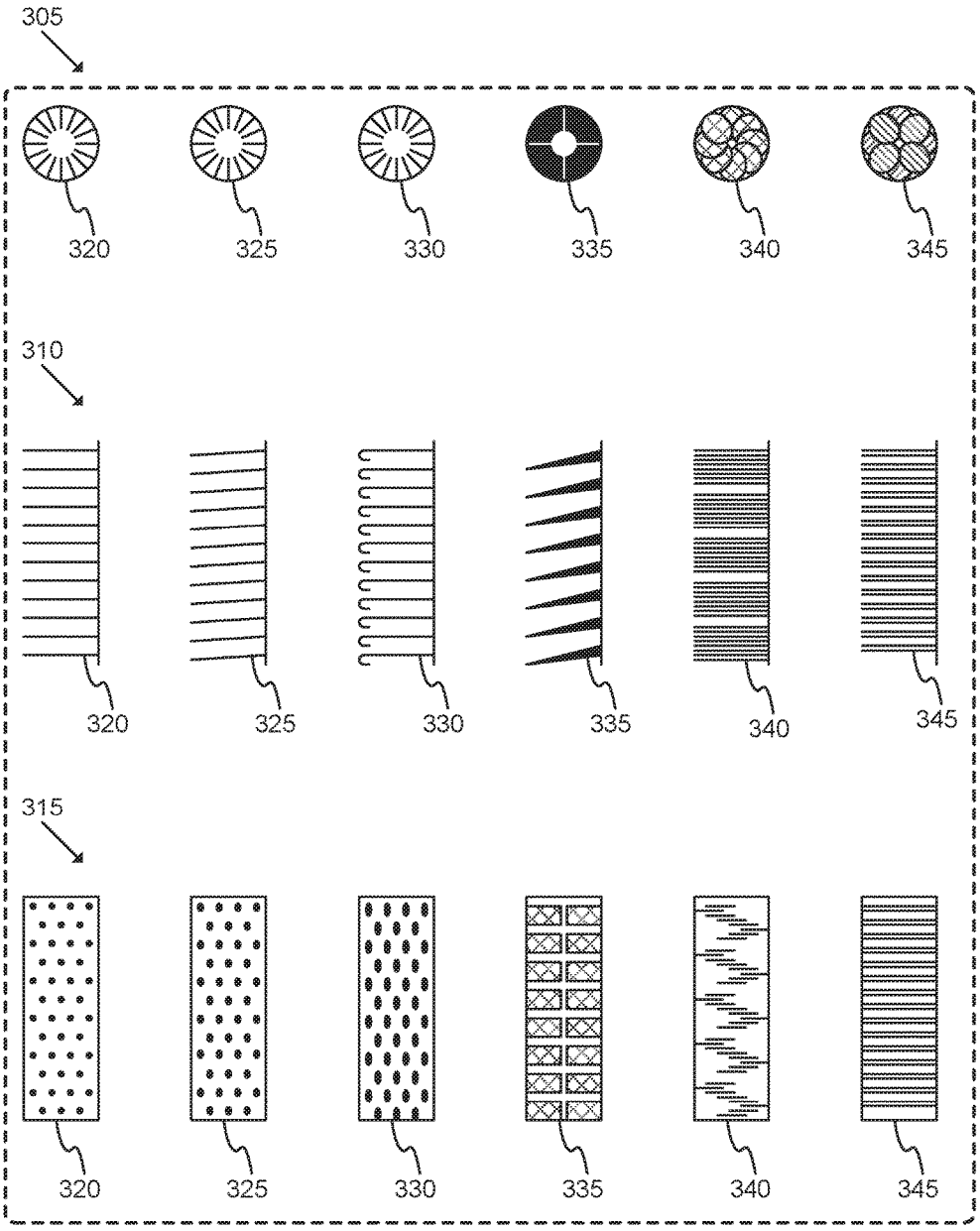
FIG. 3 illustrates various excess applique removal features provided by some embodiments of the vessel of FIG. 1.

FIG. 3 illustrates various excess applique removal features provided by some embodiments of the vessel of FIG. 1. Specifically, the figure shows top 305, side 310, and front 315 views of the various removal features of some embodiments. As shown, the various features 320-0345 may include various shapes, sizes, lengths, orientations, etc. of elements. Different embodiments may be arranged in various different ways, as appropriate.

The examples of FIG. 3 are provided for illustrative purposes only and are not meant to be limiting in any way. The first example configuration 320 may include a set of protuberances that are evenly spaced radially about the vessel (as shown in view 305). Each protuberance may extend perpendicularly from the vessel wall (as shown in view 310). In addition, each protuberance may be viewed as a point extending out from the vessel wall (as shown in view 315).

The second example configuration 325 may include a set of protuberances that are evenly spaced radially about the vessel (as shown in view 305). Each protuberance may extend at an acute angle from the vessel wall (as shown in view 310). In addition, each protuberance may be viewed as an ellipse extending out from the vessel wall (as shown in view 315).

The third example configuration 330 may include a set of protuberances that are evenly spaced radially about the vessel (as shown in view 305). Each protuberance may extend from the vessel wall (e.g., perpendicular to the wall, at an angle from the wall, etc.) and may include a "hook" tip, as is typical of a hook and loop type fastener, (as shown in view 310). In addition, each protuberance may be viewed as an elongated ellipse extending out from the vessel wall (as shown in view 315).

The fourth example configuration 335 may include a set of protuberances that are evenly spaced radially about the vessel (as shown in view 305) to form a valve. Each protuberance may extend at an acute angle from the vessel wall and may include a generally flat surface (as shown in view 310). In addition, each protuberance may be viewed as a rectangle extending out from the vessel wall (as shown in view 315).

The fifth example configuration 340 may include a set of generally round shaped protuberances that are evenly spaced radially about the vessel (as shown in view 305) to form a valve. Each protuberance may extend from the vessel wall (e.g., perpendicular to the wall, at an angle from the wall, etc.) and may include a generally flat surface (as shown in view 310). In addition, each protuberance may be viewed as a rectangle extending out from the vessel wall (as shown in view 315). In such a valve each element may overlap one or more other elements, such that a central passageway is bordered by each valve element.

The sixth example configuration 345 may include a set of generally round shaped protuberances that are evenly spaced radially about the vessel (as shown in view 305) to form a valve. Each protuberance may extend perpendicularly from the vessel wall and may include a generally flat surface (as shown in view 310). In addition, each protuberance may be viewed as a rectangle extending out from the vessel wall (as shown in view 315). In such a valve each element may be implemented in a layer that may overlap another layer formed by other valve elements, such that a central passageway is bordered by the layers of valve elements.

Different embodiments may optimize the various types, dimensions, materials, etc. of the structures described in reference to FIG. 3 based on various appropriate factors (e.g., type of material to be applied, applicator characteristics, etc.). For instance, the number of protuberances, the thickness of each protuberance (and/or rigidity and/or other appropriate physical characteristic of materials used), shape of each protuberance along a first set of dimensions (e.g., elliptical, wedge or triangle shaped, flat layers of uniform thickness, angled layer, etc.), shape of each protuberance along a second set of dimensions (e.g., elliptical, linear, polygonal, etc.), angle of extension of protuberances (e.g., perpendicular to the vessel wall, at an angle to the wall, etc.) may vary among different embodiments. In addition, some embodiments may include different combinations of structures (e.g., alternating sections of a first configuration such as a set of bristles and a second configuration such as a set of valves).

Figure 4:
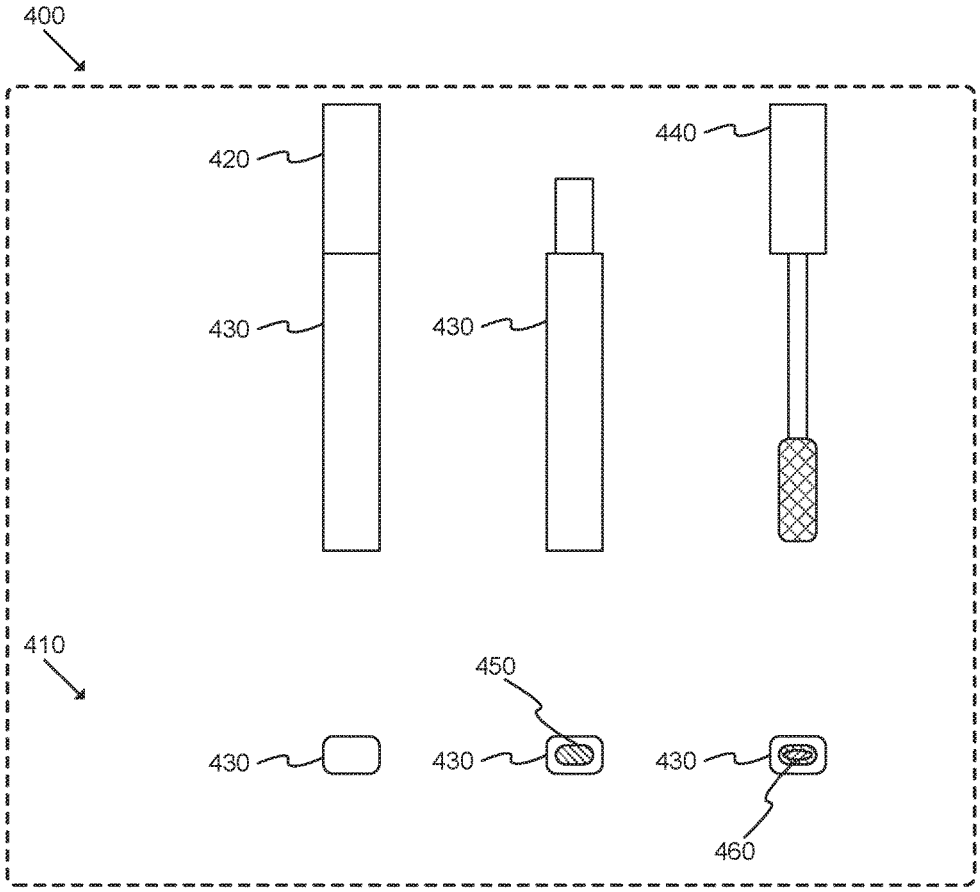
FIG. 4 illustrates side and top views of a conceptual system including an applicator and associated vessel according to an exemplary embodiment of the invention.

FIG. 4 illustrates side and top views of a conceptual system 400 including an applicator 420 and associated vessel 430 according to an exemplary embodiment of the invention. Specifically, this figure shows an example of a compression fit vessel and applicator. As shown, the vessel 430 may include an opening 450 that may be adapted to fit a particular size and shape of wand (e.g., a wand having shape 460) and applicator element (e.g., having a shape as shown with respect to opening 450).

Some embodiments may thus allow use of an applicator wand 420 and vessel 430 that are able to be connected using a compression fit that does not require, for example, securing the wand to the vessel by continuously rotating the wand relative to the vessel (i.e., "screwing" the wand into the vessel).

Some embodiments may provide a vessel (e.g., vessel 130, vessel 430, etc.) having a flexible body such that a user may squeeze the sides of the vessel during use. In this way, some embodiments may allow a user to control the amount of applique retained by an application element when the element is inserted into and removed from the vessel. Such a vessel may include various combinations of excess applique removal features, as appropriate. Thus, with a given set of applique removal features, a user may be able to achieve various levels applique applied to the application element by varying the amount of pressure applied to the sides of the vessel while removing the application element from the vessel.

One of ordinary skill in the art will recognize that compression fit embodiments such as system 400 may be implemented in various different ways without departing from the spirit of the invention. For instance, different specific shapes and/or sizes of opening, wand, applicator, vessel, etc. may be used, as appropriate.

Figure 5:
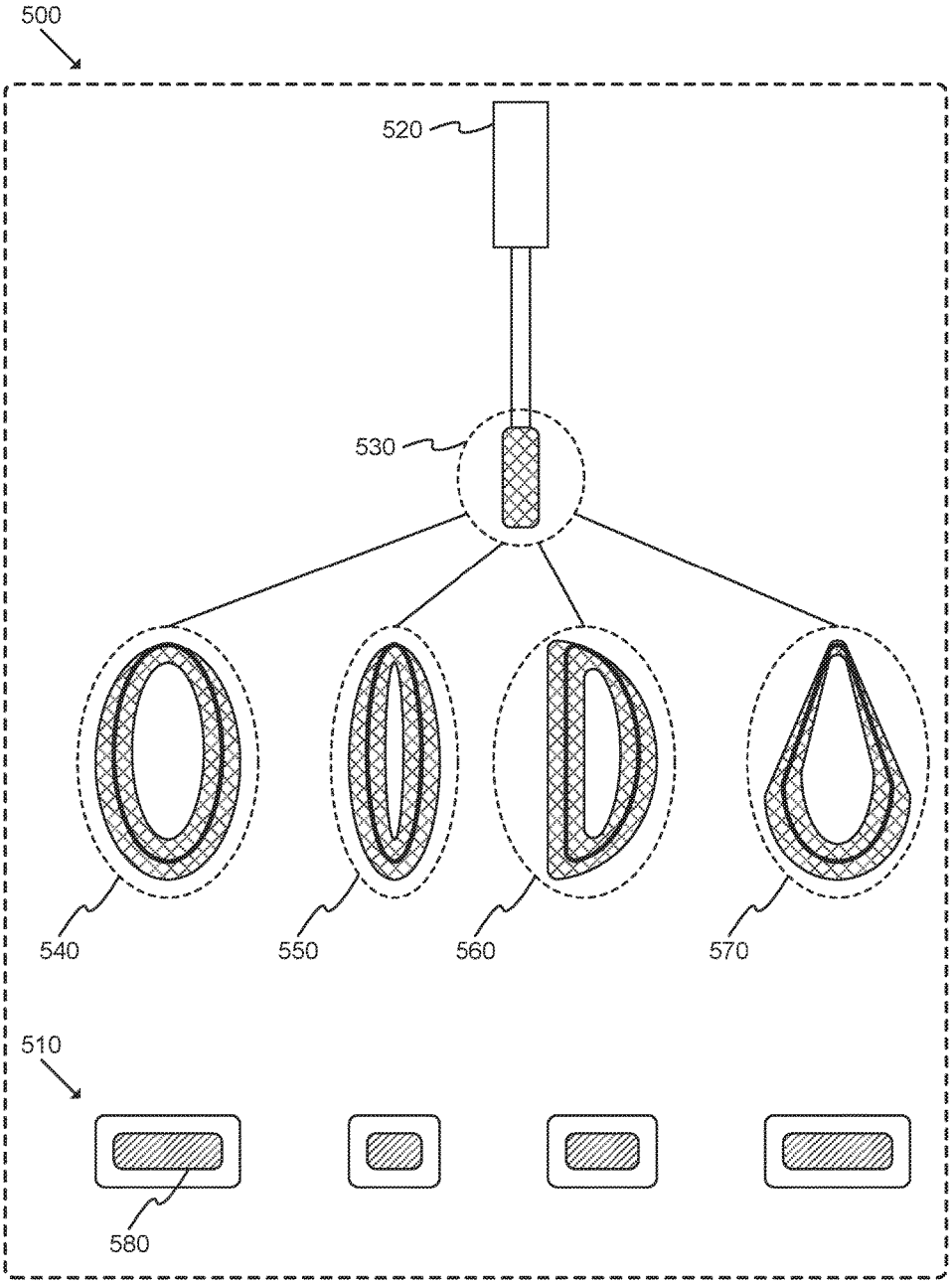
FIG. 5 illustrates side and top views of various applicator and vessel shapes according to exemplary embodiments of the invention.

FIG. 5 illustrates side 500 and top 510 views of various applicator and vessel shapes according to exemplary embodiments of the invention. Specifically, this figure shows various applicator shapes that may allow optimized placement of applicated materials and/or use of such materials. In addition, this figure shows various vessel shapes that may be associated with the described applicator shapes in some embodiments.

As shown, an applicator 520 may include various wand types, shapes, etc. (not shown), and or various applicator elements 530 (e.g., elements 540-570). Each specific applicator may be associated with a vessel that has an opening 580 that may be associated with the applicator. In addition, vessels used with some embodiments of system 500 may include various elements described above in reference to FIG. 1-5 above (e.g., one or more manipulators, materials, etc.).

As shown in FIG. 5, different embodiments may include differently shaped application elements 530. For instance, some embodiments may provide an oval shaped application element 540, a differently-shaped oval element 550, a "D"-shaped element 560, a teardrop shaped element 570, etc., as appropriate. Such shapes may allow optimum placement of applique. The shape, size, dimension, etc. of the application elements may be based at least partly on the material being applied. In some embodiments, various surfaces of each application element 530 may be sized and/or shaped to match various contours of a human face (e.g., eye radius, width, height, etc.), various characteristics of an associated applique (e.g., viscosity, color, etc.), etc. Alternatively, some embodiments may include a traditional application element (not shown), for example forming an arc with a set of radially protruding bristles.

Each application element may include a frame and a set of protuberances. The frame may typically include a section of rigid wire (and/or other appropriate element) and each protuberance may be, for example, a bristle.

Figure 6:
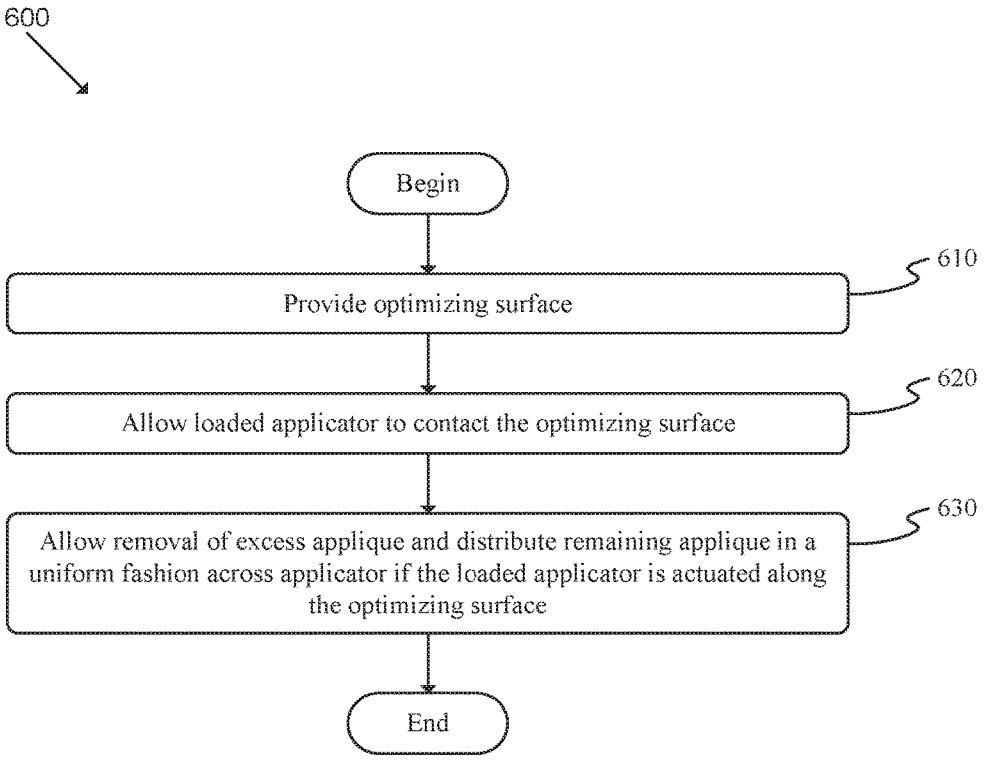
FIG. 6 illustrates a flow chart of a conceptual process used by some embodiments to allow placement of an optimal level of applique on an applicator.

FIG. 6 illustrates a flow chart of a conceptual process 600 used by some embodiments to allow placement of an optimal level of applique on an applicator. The process may begin, for instance, when an applicator and/or vessel of some embodiments is made available to a user. As shown, the process may provide (at 610) an optimizing surface. Such a surface may be similar to those described in reference to FIGS. 2-3.

Next, process 600 may allow (at 620) a loaded applicator to contact the optimizing surface. Such an applicator may include an element similar to applicator element 160 described above in reference to FIG. 1 above. Process 600 may then allow (at 630) removal of excess applique (e.g., by allowing the applicator element 160 to be dragged across a manipulator of some embodiments to facilitate distribution of remaining applique in a uniform fashion across an applicator if the loaded applicator is actuated along the optimizing surface).

For example, a user may remove an applicator (e.g., applicator 120) from a vessel (e.g., vessel 220), such that various bristles of an application element (e.g., element 160) of the applicator engage a manipulator of some embodiments (e.g., manipulator 230 or 240) in order to remove excess applique from the applicator. Contact of the application element to the manipulator(s) may be at least partly determined, in some embodiments, by pressure applied to the exterior of a vessel (e.g., a user may squeeze the sides of the vessel).

One of ordinary skill in the art will recognize that process 600 may be implemented in various appropriate ways without departing from the spirit of the invention. For instance, a user may engage an application element and manipulator in various appropriate ways. As another example, the various operations of process 600 may be implemented in various different orders (and/or various other operations may be added and/or various operations may be removed). As another example, different embodiments may combine various distinct operations into a single operation, divide various single operations into multiple operations, and/or otherwise manipulate the operations performed. Likewise, various single operations may be divided into multiple sub-operations. As another example, the process may be performed as a sub-process of a larger macro process and/or divided into multiple sub-processes, as appropriate.

While the invention has been described with reference to numerous specific details, one of ordinary skill in the art will recognize that the invention can be embodied in other specific forms without departing from the spirit of the invention. For example, several embodiments were described above by reference to particular features and/or components. However, one of ordinary skill in the art will realize that other embodiments might be implemented with other types of features and components. One of ordinary skill in the art would understand that the invention is not to be limited by the foregoing illustrative details, but rather is to be defined by the appended claims.

I claim:

1. An applique system for storing and applying applique, the system comprising:

a vessel including:

a cylindrical flexible body that stores applique; and a protruding neck having a radius that is less than a radius of the cylindrical flexible body;

a removable top including an application element;

a first applique removal feature positioned along a portion of the cylindrical flexible body, wherein the first applique removal feature comprises a plurality of overlapping round protuberances; and a second applique removal feature positioned along a portion of the protruding neck.

2. The system of claim 1, wherein the flexible body and the top are coupled via a compression fit.

3. The system of claim 1, wherein the first applique removal feature includes a first set of protruding bristles and the second applique removal feature comprises a second set of protruding bristles.

4. The system of claim 1, wherein the flexible body allows the applique removal feature to be positioned relative to the application element, based at least partly on pressure applied to the flexible body, during extractions of the top from the flexible body.

* * * * *